US011274447B2

(12) United States Patent
Schmidgall et al.

(10) Patent No.: US 11,274,447 B2
(45) Date of Patent: Mar. 15, 2022

(54) LIFT HOLE FORMING DEVICE FOR CONCRETE PRODUCTS

(71) Applicant: HawkeyePedershaab Concrete Technologies, Inc., Clayton, MO (US)

(72) Inventors: Aaron Schmidgall, Mediapolis, IA (US); Bryan Moehle, Mediapolis, IA (US); Dave Strabala, Mediapolis, IA (US); James Wright, Ludington, MI (US); Mike McDonald, Ludington, MI (US)

(73) Assignee: HAWKEYEPEDERSHAAB CONCRETE TECHNOLOGIES, INC, Clayton, MO (US)

( * ) Notice: Subject to any disclaimer, the term of this patent is extended or adjusted under 35 U.S.C. 154(b) by 67 days.

(21) Appl. No.: 16/907,572

(22) Filed: Jun. 22, 2020

(65) Prior Publication Data

US 2021/0254341 A1 Aug. 19, 2021

Related U.S. Application Data

(60) Provisional application No. 62/977,950, filed on Feb. 18, 2020.

(51) Int. Cl.
*E04C 5/18* (2006.01)
*B28B 23/00* (2006.01)

(52) U.S. Cl.
CPC ..... *E04C 5/18* (2013.01); *B28B 23/0025* (2013.01)

(58) Field of Classification Search
CPC ..... E04C 5/18; B28B 23/0025
USPC ..... 52/677
See application file for complete search history.

(56) References Cited

U.S. PATENT DOCUMENTS 75,098 A * 3/1868 Vineland ..... E04C 5/04 52/660
3,563,131 A * 2/1971 Ridley, Sr. ..... F16B 35/04 411/384
3,840,054 A * 10/1974 Tolliver ..... E04C 5/0609 138/175
4,939,883 A * 7/1990 Swenson ..... E04C 5/18 52/649.8
4,989,388 A * 2/1991 Schmidgall ..... E04C 5/168 52/649.8
4,999,965 A * 3/1991 Schmidgall ..... E04C 5/064 52/649.8

(Continued)

FOREIGN PATENT DOCUMENTS

EP 0349985 A1 * 1/1990 ..... E04C 5/18
GB 1344294 A * 1/1974 ..... E04C 5/0609

(Continued)

*Primary Examiner* — Brian D Mattei
*Assistant Examiner* — Joseph J. Sadlon
(74) *Attorney, Agent, or Firm* — Shuttlewoth & Ingersoll, PLC; Jason R. Sytsma

(57) ABSTRACT

A continuous length of spring-steel material of a substantially round cross-section formed with a bent section comprising a radius corresponding to an outer diameter of the pipe. A hook section is combined at one end of the continuous length of spring-steel material where the hook is formed to grab one of the wires of the cage to hold the pipe in position. A lateral leg is positioned at the other end of the continuous length of spring-steel material and is formed to grab another one of the wires of the cage to the hold the pipe in position.

13 Claims, 9 Drawing Sheets

(56) References Cited

U.S. PATENT DOCUMENTS 5,896,722 A * 4/1999 Swenson ..... E04C 5/163 52/712
6,128,882 A * 10/2000 Jones ..... E04C 5/166 52/665
6,421,977 B2 * 7/2002 Timperman ..... E04C 3/02 52/714
6,655,105 B2 * 12/2003 Swenson ..... E04C 5/163 403/391
6,739,105 B2 * 5/2004 Fleming ..... E04B 5/10 52/513
8,590,246 B2 * 11/2013 Coccagna ..... E04C 5/168 52/442
9,273,460 B2 * 3/2016 Hohmann, Jr. ..... E04B 2/30
11,193,278 B2 * 12/2021 Kim ..... E04C 5/07
2002/0078649 A1 * 6/2002 Clapp ..... E04B 2/86 52/426
2003/0024204 A1 * 2/2003 Swenson ..... E04C 5/167 52/677
2005/0178294 A1 * 8/2005 Straub ..... E02B 3/06 106/675
2011/0283648 A1 * 11/2011 Vitt ..... E04C 5/065 52/565
2012/0317921 A1 * 12/2012 Colton ..... E04C 5/163 52/712
2014/0308474 A1 * 10/2014 Subacchi ..... E04C 5/168 428/81
2018/0163403 A1 * 6/2018 McCarthy ..... E04C 5/168
2019/0368197 A1 * 12/2019 Johnson, III ..... E04C 5/168

FOREIGN PATENT DOCUMENTS

JP 5610270 B2 * 10/2014 ..... E04C 5/18
JP 6209416 B2 * 10/2017 ..... E04B 2/8658
JP 6224336 B2 * 11/2017 ..... E04B 2/8658
WO WO-9425701 A1 * 11/1994 ..... E04C 5/012
WO WO-0129342 A1 * 4/2001 ..... E04B 2/8658

* cited by examiner

LIFT HOLE FORMING DEVICE FOR CONCRETE PRODUCTS

This application claims priority to Provisional Patent Application No. 62/977,950 filed Feb. 18, 2020, the entirety of which is incorporated by reference herein.

TECHNICAL FIELD

This disclosure relates to the production of concrete products, and more specifically, this disclosure relates to a lift hole forming device for forming concrete products.

BACKGROUND INFORMATION

In producing large concrete products such as box sections, round pipes, culverts or manholes, reinforcement wire mesh cages are required to provide the necessary strength. For concrete products of sufficient weight it is also necessary to have a way for moving the product after it is cured. Often, producers will form a handling access hole through the product for receiving a lifting mechanism, such as chains, cables, and the like to lift and transport the product. Accordingly, there is a need for an improved lift hole forming device that can be used to secure a pipe to the reinforcement cage during the forming process.

SUMMARY

A lift hole forming device for positioning a pipe section between an inner and an outer concrete reinforcement cage used in forms for producing concrete structures such as box sections and pipes, is provided. The reinforcement cages each have a plurality of parallel spaced-apart horizontal wires joined to a plurality of parallel spaced-apart vertical wires. The reinforcement cages are positioned in a form that has spaced-apart inner and outer surfaces.

In one implementation, a first spacer is attachable to an inner concrete reinforcement cage of the concrete product. A second spacer is attachable to an outer concrete reinforcement cage of the concrete product. A pipe extends between the inner concrete reinforcement cage and the outer concrete reinforcement cage and is held in place by the first spacer and the second spacer. When cast in concrete, the pipe forms the lift hole for receiving a lifting mechanism for lifting the concrete product.

The first spacer can further comprise of a continuous length of material comprising a central section bent at a radius corresponding to the radius of the pipe and configured to rest against the radius of the pipe, a first leg and a second leg extending on opposite sides of the central section, a first formed section for combining the first spacer at one end to the inner concrete reinforcement cage and a second formed section for combining the first spacer at the other end to the inner concrete reinforcement cage.

In another implementation, the spacer can be combinable to each of the reinforcement cages and comprises of a continuous length of spring-steel material of a substantially round cross-section formed with a first formed section, a central section designed to rest against the radius of the pipe and a second formed section. The first formed section can be a hook section combined at one end of the continuous length of spring-steel material where the hook is formed to attach to one of the wires of the cage to hold the pipe in position. The second formed section can be a lateral leg positioned at the other end of the continuous length of spring-steel material and is formed to attach to another one of the wires of the cage to the hold the pipe securely in position.

In one example of such a device, a continuous length of spring-steel material can further comprise a first straight section extending from the bent section and the lateral leg. The lateral leg is bent forward by an angle β with respect to the straight section. The continuous length of spring-steel material can further comprise a second straight section between the other end of the bent section and the hook section. The bent section can comprise a degree of bend represented by a degree of 2α wherein each of the first straight section and the second straight section are separated from the radius by a degree α.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
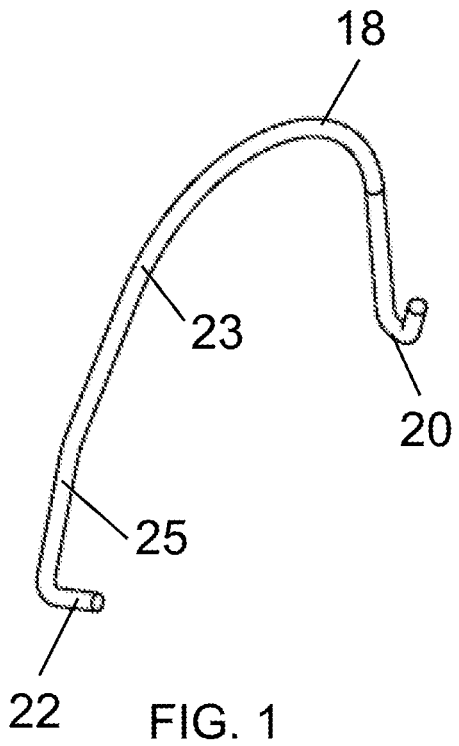
FIG. 1 is a left-side perspective view of a device for securing a pipe in a wall section of a concrete product
Figure 2:
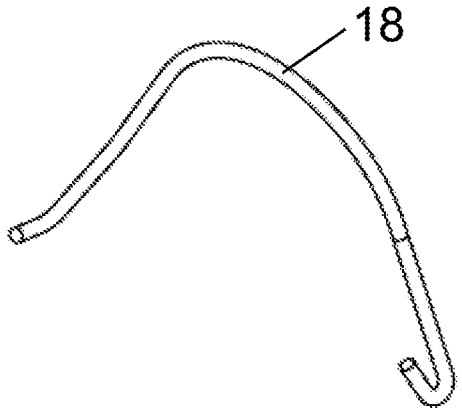
FIG. 2 is a right-side perspective view of the spacer of FIG. 1.
Figure 3:
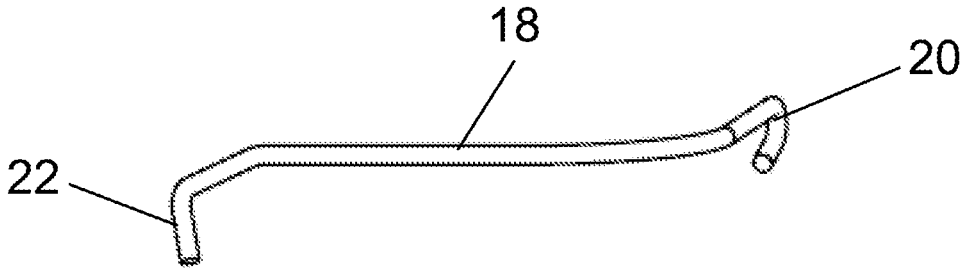
FIG. 3 is a top view of the spacer of FIG. 1.
Figure 4:
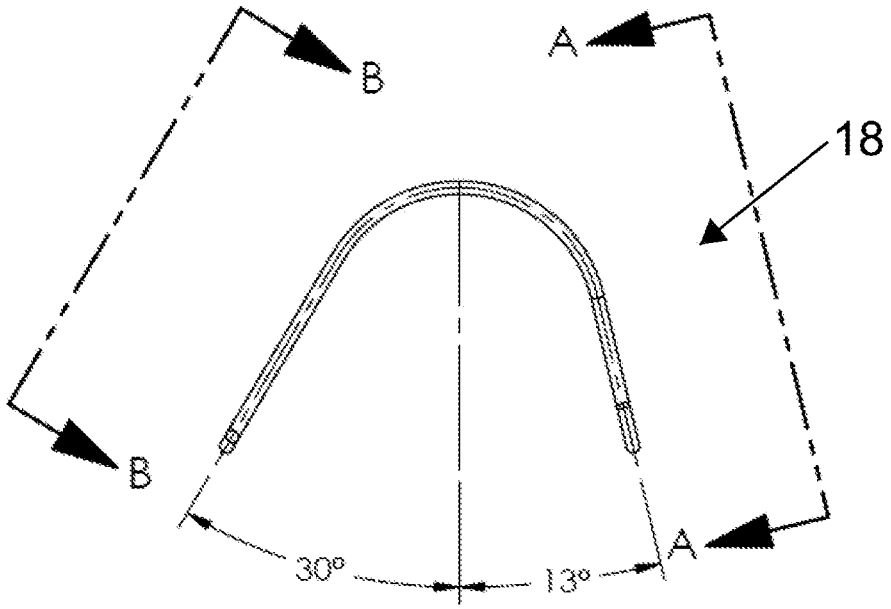
FIG. 4 is a front view of the spacer of FIG. 1.
Figure 5:
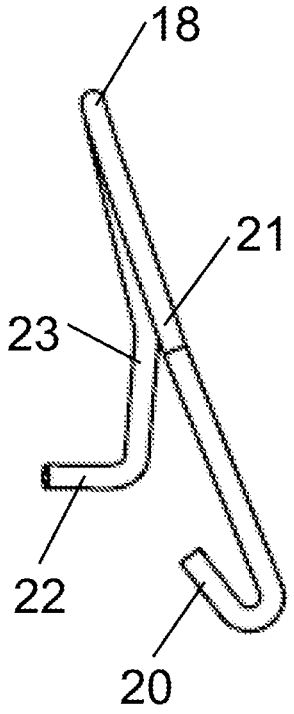
FIG. 5 is a side view of the spacer of FIG. 1 from the direction A-A of FIG. 4.
Figure 6:
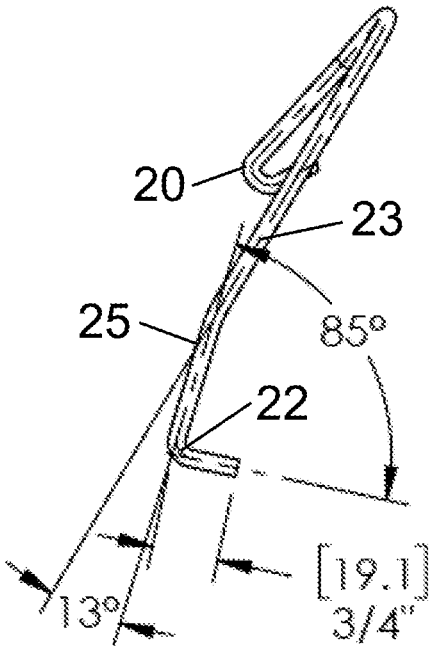
FIG. 6 is a side view of the spacer of FIG. 1 from the direction of B-B of FIG. 5.
Figure 7:
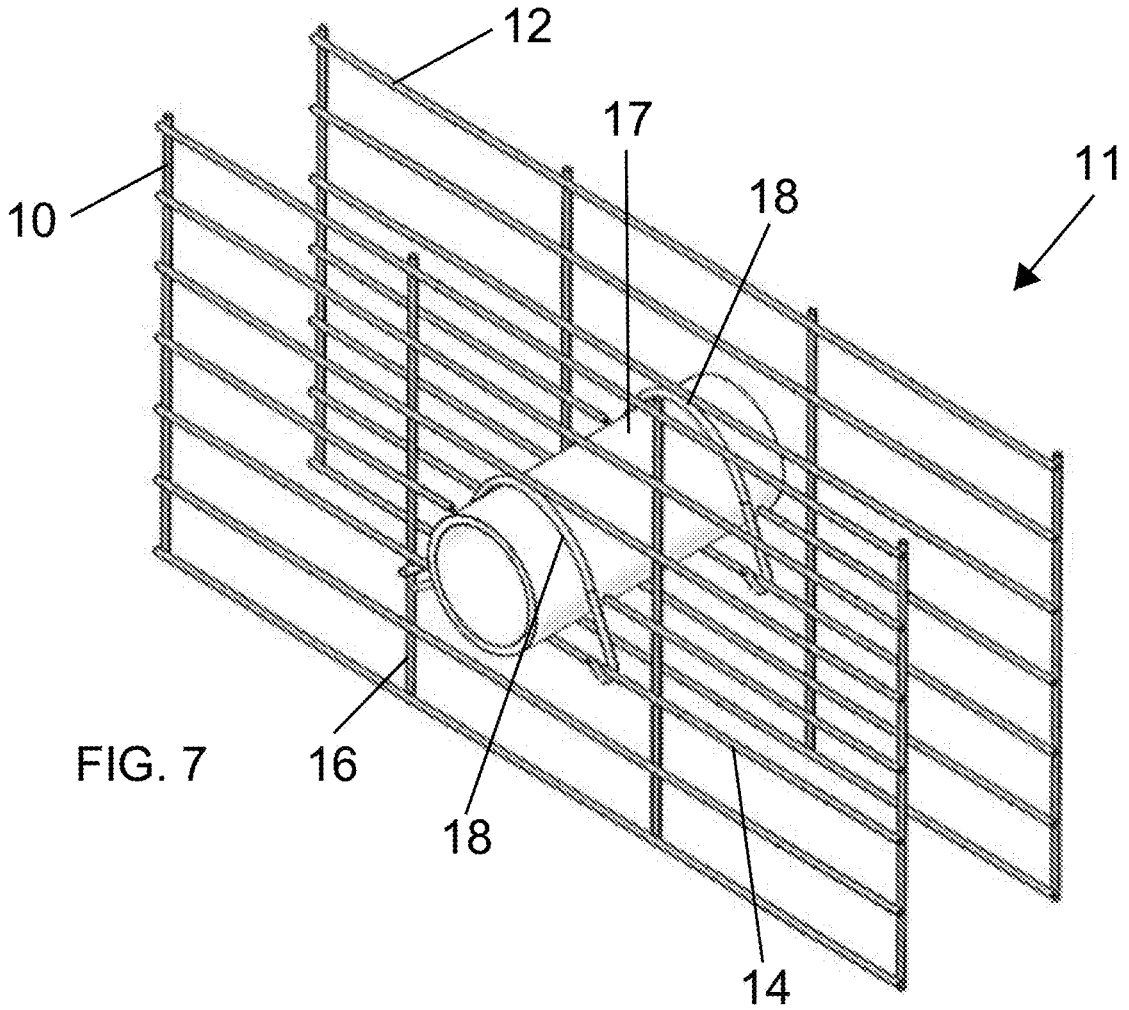
FIG. 7 is a side view illustrating a portion of two wire mesh cages and a pipe extending between them secured by the devices of an embodiment of the invention.
Figure 8:
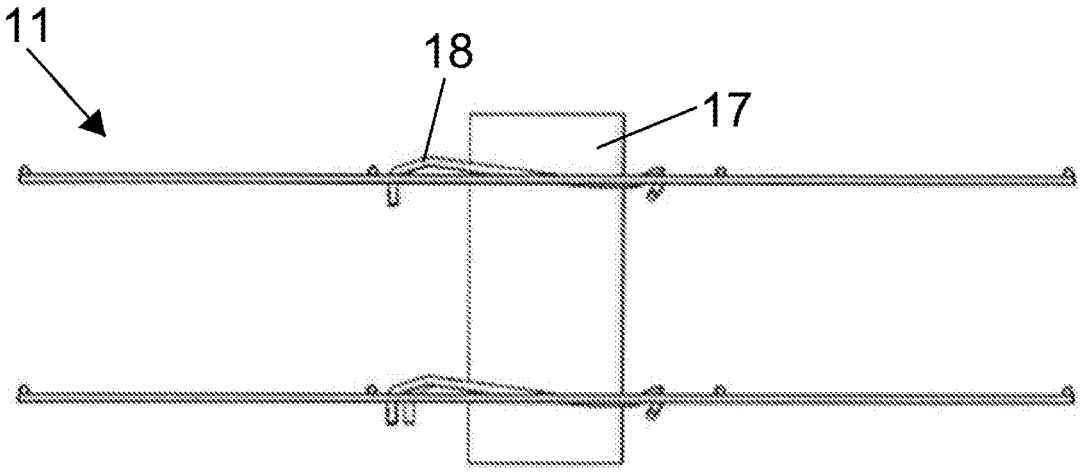
FIG. 8 is a top view of the arrangement of FIG. 7 showing a portion of two wire mesh cages and the pipe extending between them.
Figure 9:
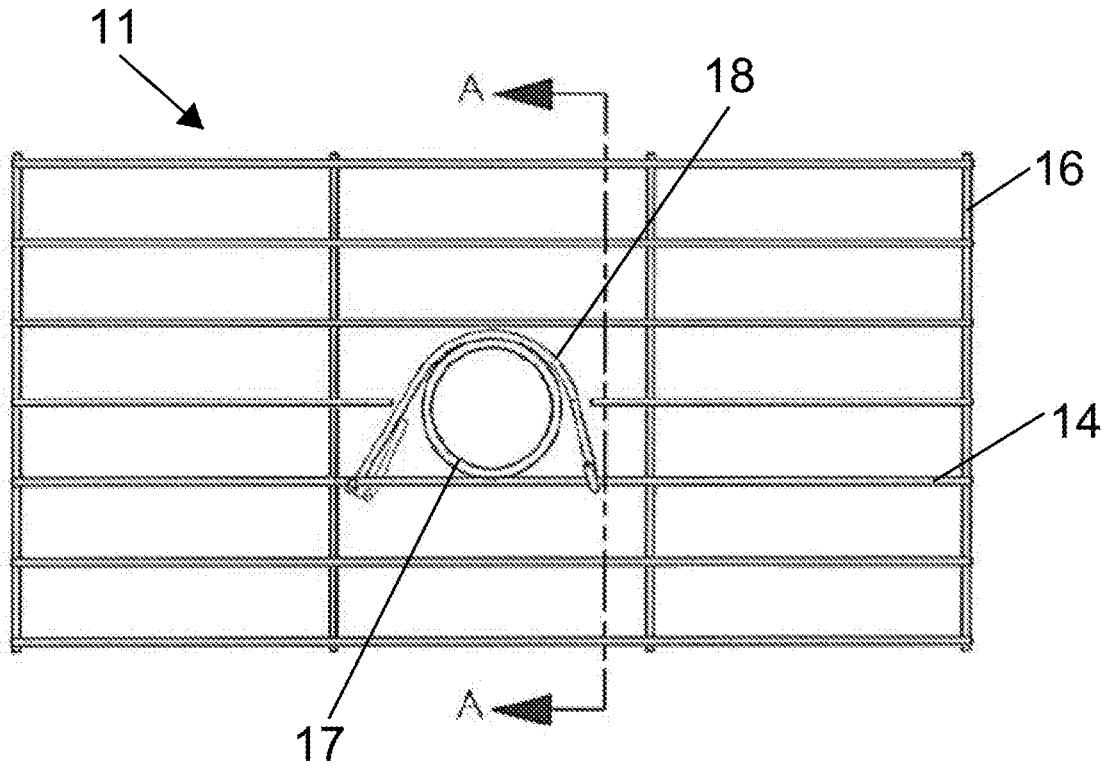
FIG. 9 is a front view of the arrangement of FIG. 7 showing a portion of two wire mesh cages and the pipe extending between them.
Figure 10:
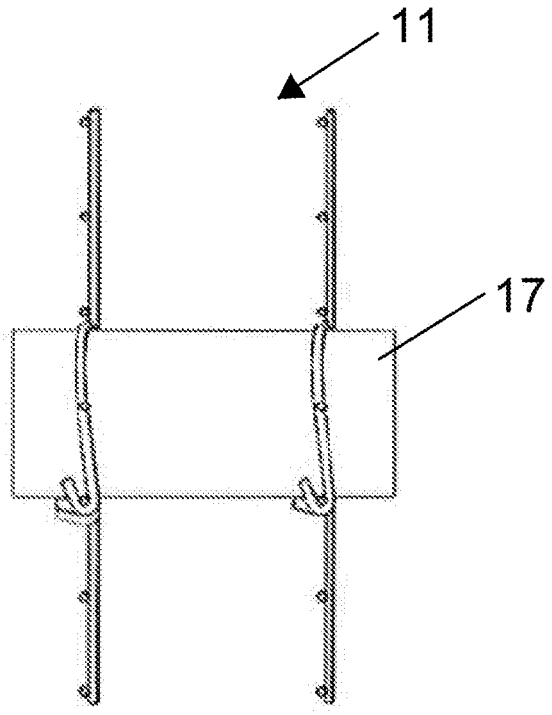
FIG. 10 is a side view of the arrangement of FIG. 7 showing a portion of two wire mesh cages and a pipe extending between them.
Figure 11:
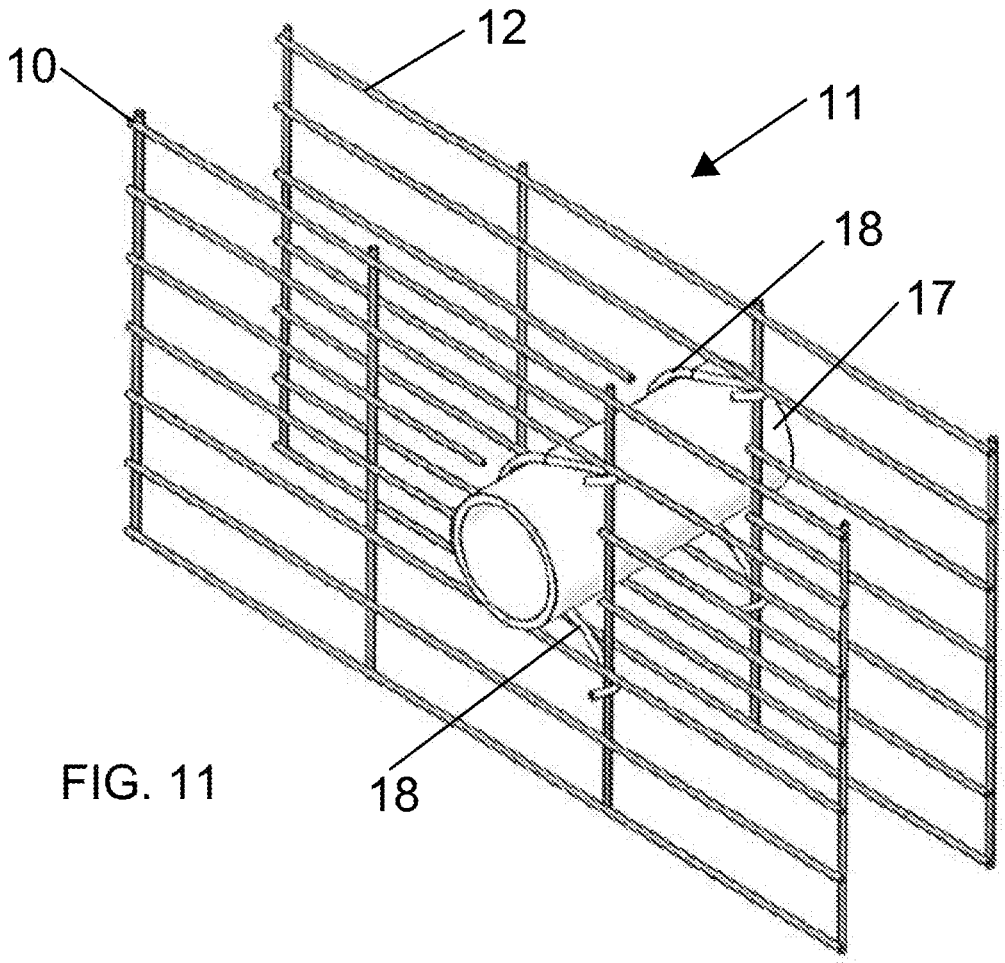
FIG. 11 is a perspective view illustrating a portion of two wire mesh cages and a pipe extending between them secured by the devices on the vertical wires.
Figure 12:
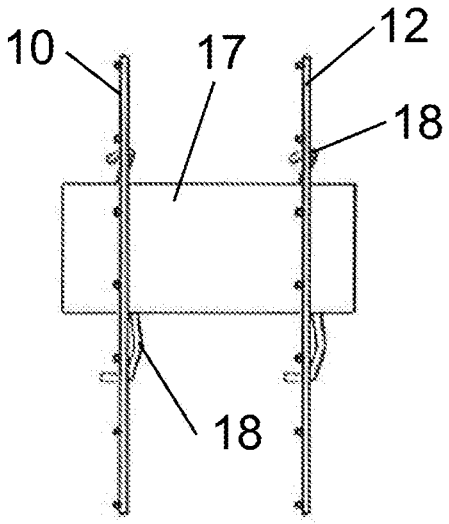
FIG. 12 is a top view of the arrangement of FIG. 8.
Figure 13:
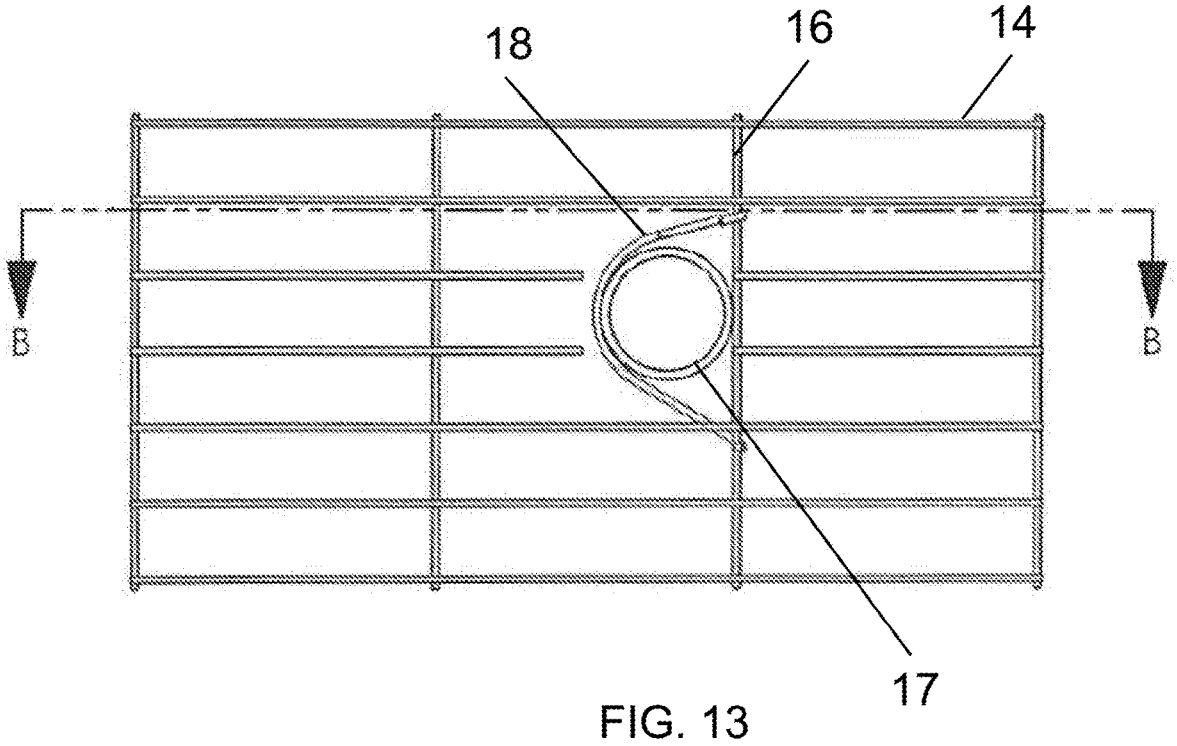
FIG. 13 is a front view of the arrangement of FIG. 8.
Figure 14:
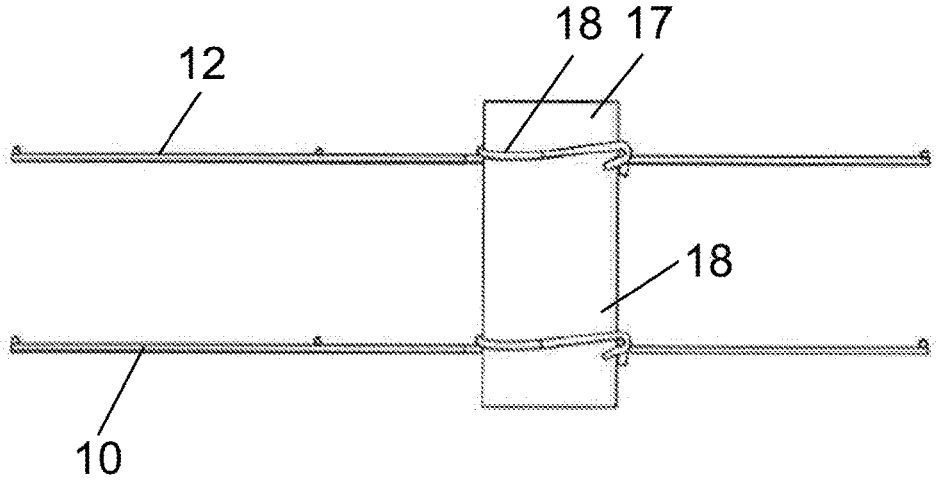
FIG. 14 is the view from the direction B-B of FIG. 13.
Figure 15:
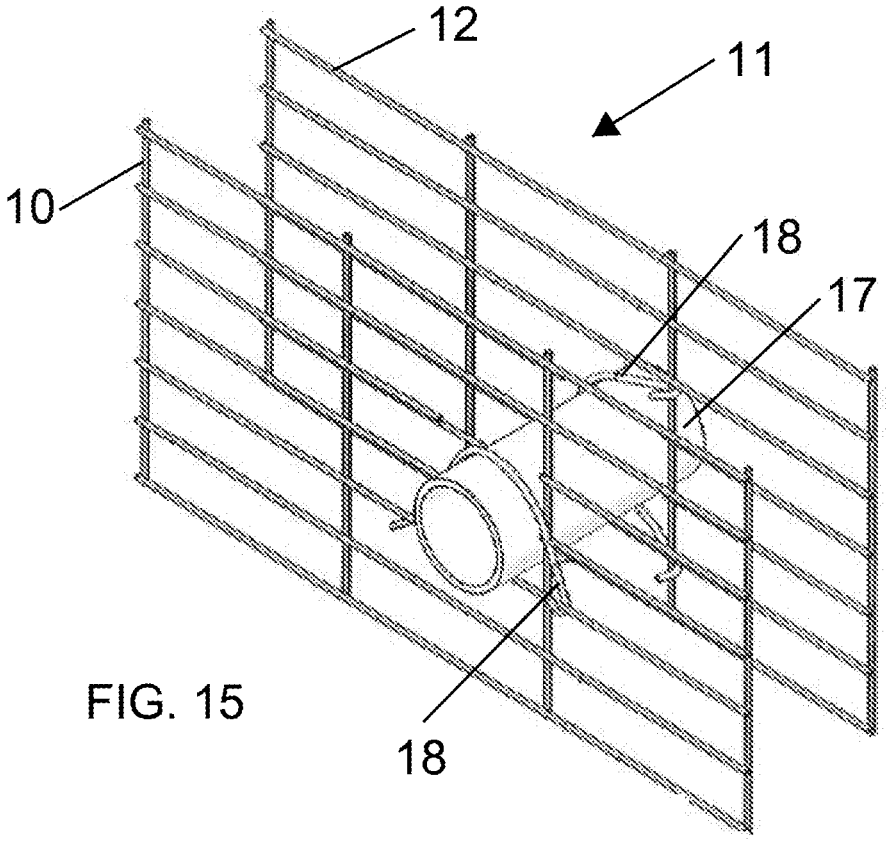
FIG. 15 is a perspective view illustrating a portion of two wire mesh cages and a pipe extending between them secured by the devices on the vertical wires on one of the wire mesh cages and the horizontal wires on the other wire mesh cage.
Figure 16:
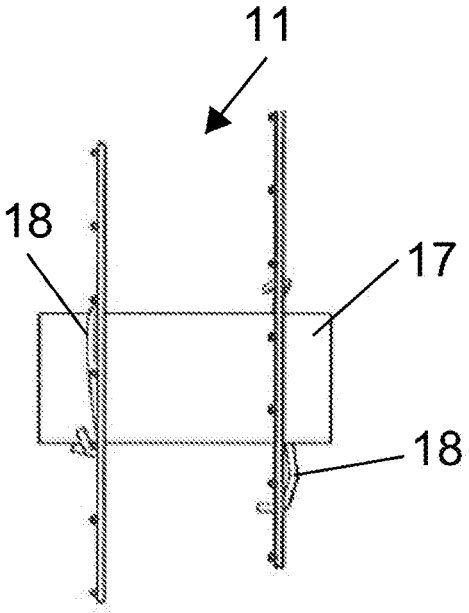
FIG. 16 is a side view of the arrangement of FIG. 15.
Figure 17:
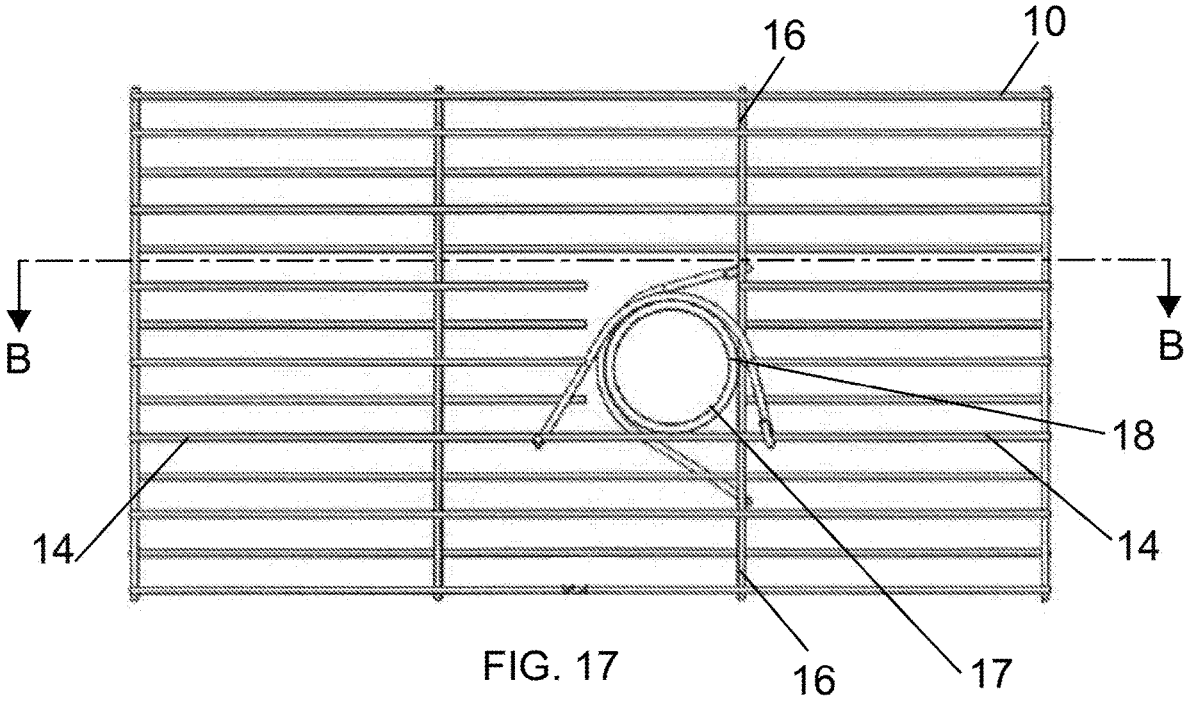
FIG. 17 is a front view of the arrangement of FIG. 15.
Figure 18:
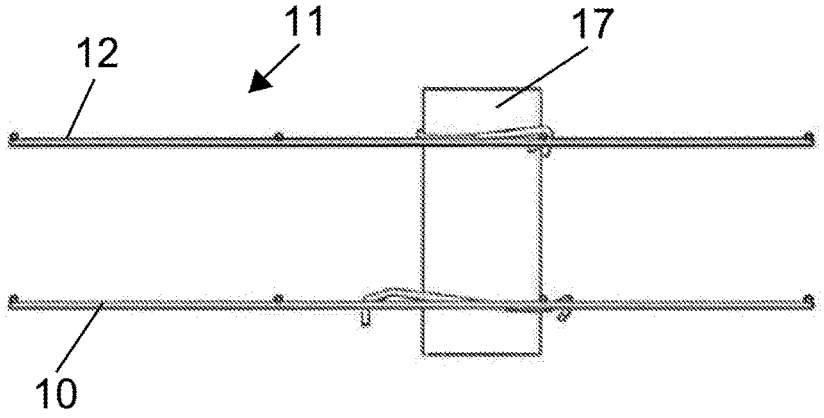
FIG. 18 is a view from the direction B-B of FIG. 17.

Referring to FIGS. 1-6, there is illustrated a spacer 18 for a pipe 17 (shown in FIG. 7 below) in a concrete product. Spacer 18 can be generally u-shaped with central section with a radius corresponding to the outer diameter of pipe 17. Spacer 18 has a first leg 21 and a second leg 23 extending on opposite ends of the central section and away from each other at an angle α, which can be any angle between 1 degree and 45 degrees (or any angle in between), but with a preferred angle is 30 degrees.

First leg 21 and second leg 23 can have a first formed section and a second formed section, respectively. In one implementation, first leg 21 terminates with a first formed section configured as a hook section 20. Second leg 23 terminates with a second formed section configured as a lateral leg 22, although another hook section can be provided. Hook section 20 at the end of first leg 21 is used for securing spacer to either vertical wire 16 or horizontal wire 14 of one of inner concrete cage 10 and outer concrete cage 12 (as discussed below). Second leg 23 can be manually flexed away from first leg 21 so that lateral leg 22 can secure to another one of either vertical wire 16 or horizontal wire 14 of one of inner concrete cage 10 and outer concrete cage 12. In order to make spacer 18 easier to install an end portion 25 of second leg 23 can be bent at an angle β (see FIG. 6), which can be 1 degree to 20 degrees or any angle in between. The illustrated embodiment shows an angle β of 13 degrees. The functions of the various configurations of the spacer are best understood by an explanation of how spacer 18 is installed on the cages 10 and 12.

Referring to FIGS. 7-10, there is illustrated a reinforcement wire mesh cage 11, which is required for manufacturing larger round and rectangular pipes, culverts and manhole concrete products. Wire mesh cage 11 comprises of an inner cage 10 and an outer cage 12 that each have a plurality of parallel spaced apart vertical wires 16 joined to a plurality of horizontally spaced apart parallel circumferential wires 14. As is well known to those skilled in the art, these cages 10 and 12 are positioned inside of the annular space defined by the forms used in producing a particular rectangular or cylindrical concrete product that will ultimately used as a box section, a pipe, culvert, or manhole. The cages 10 and 12 therefore must be properly positioned inside of the annular space between the forms, which space will be filled with concrete surrounding the inner concrete cage 10 and outer concrete cage 12 so it is important that the cages 10 and 12 be properly spaced from each other and also properly spaced from the surfaces of the form. It is also important that the cages maintain the proper position throughout the process of producing the concrete product. Since these processes employ vibration and other forces to assure that all of the voids in the form are filled with concrete, twisting and other forces are exerted upon the cages 10 and 12 during the process of manufacture. The spacers 18 constructed according to the principles of the invention are capable of resisting all of the forces, twisting and otherwise, and once in place, the spacers 18 of the invention will not fall off even though not welded or otherwise tied to the cages 10 and 12.

As can be seen, a pipe 17 extends between cages 10 and 12. Once the concrete product has formed, this pipe 17 can receive a chain for lifting and moving the concrete product. Pipe 17 can be made of plastic, PVC, steel, or any other material. To keep pipe 17 oriented in the correct position during the forming and curing process, spacer 18 is provided.

The installer is normally outside of the outer cage 12 and pipe 17 is extended between cages 10 and 12. To install spacer 18 on one of the cages 10 and 12, the installer grasps one end of spacer 18 and inserts it inwardly between one of the horizontal wires 14 or vertical wires 16 on one of cages 10 and 12 so that hook section 20 of first leg 21 grasps the wire and the top of the radius is around pipe 17. Spacer 18 is then pulled outwardly until the lateral leg 22 on the second leg 23 is around another one of horizontal wires 14 or vertical wires 16 and then is let go and its resiliency causes it to return to its normal bend to hold pipe 17 in place. Another spacer 18 can be added in a similar manner to the inner cage 10 to hold pipe 17 at both ends.

FIGS. 11-14 show wire mesh cage 11 with inner cage 10 and outer cage 12 and pipe 17 extending therebetween that is held in place by spacer 18 that is attached to vertical wires 16 on inner cage 10 and outer cage 12. FIGS. 15-18 show wire mesh cage 11 with inner cage 10 and outer cage 12 and pipe 17 extending therebetween that is held in place by spacer 18 that is attached to one vertical wires 16 and one horizontal wire 14 on inner cage 10 and another spacer 18 attached in the same manner on outer cage 12. These sets of figures illustrate the various manners in which spacer 18 can be connected to wire mesh cage 11.

When properly installed as described above, the configuration of spacer 18 tightly locks the pipe 17 between the inner cage 10 and outer cage 12. Because of the resiliency of the spring steel used in forming spacer 18, it has an inherent locking feature provided by the unique configuration at each end of the spacer 18 of the invention, the spacers 18 will not fall off during the manufacturing process, and the spacers 18 will resist forces in any direction without becoming loose.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

We claim:

1. A spacer for positioning a pipe between an inner and an outer concrete cage used in forms for producing concrete structures such as box sections and pipes, which cages each have a plurality of parallel spaced-apart horizontal wires joined to a plurality of parallel spaced-apart vertical wires and which cages are positioned in a form that has spaced-apart inner and outer surfaces, said spacer comprising:

a continuous length of spring-steel material of a substantially round cross-section formed with a central section bent at a first radius corresponding to an outer diameter of the pipe with a first leg and a second leg extending from opposite sides of the central section, a hook section at an end of the first leg and bent at a second radius and configured to grab one of the wires of the cage to hold the pipe in position, and a lateral leg at an end of an end portion of the second leg and bent at a third radius configured to grab another one of the wires of the cage to the hold the pipe in position, wherein the first leg and a portion of the second leg are coplanar on a first plane and wherein the first radius is perpendicular to the second radius wherein the second leg further comprises the end portion bent forward by an angle β and the end portion of the second leg is bent forward of the first plane by the angle β with the third radius forward of the second radius and the first plane.

2. The spacer of claim 1, wherein the angle β is one degree to twenty degrees or any angle in between.

3. The spacer of claim 2, wherein the angle β is substantially near thirteen degrees.

4. The spacer of claim 1, wherein the first leg and the second leg are separated by an angle of bend represented by a degree of 2α wherein each of the first leg and the second leg are separated from the first radius by an angle of α.

5. The spacer of claim 4, wherein the angle of α is one degree to forty five degrees or any angle in between.

6. The spacer of claim 5, wherein the angle of α is substantially near thirty degrees.

7. The spacer of claim 1, wherein the third radius is eighty five degrees.

8. A spacer for positioning a pipe between inner and outer concrete cages, the spacer comprising:

a continuous length of material bent at a first radius corresponding to the radius of the pipe and comprising a first leg and a second leg extending on opposite sides, wherein the second leg further comprises of an end portion bent forward by an angle β;

a hook section at an end of the first leg and bent at a second radius; and one of a hook section and a lateral leg at an end of the end portion of the second leg and bent at a third radius, wherein the first leg and a portion of the second leg are coplanar on a first plane and the end portion of the second leg is bent forward of the first plane by the angle β with the third radius forward of the second radius and the first plane, and wherein the first radius is perpendicular to the second radius, and wherein the hook section of the first leg is combinable to one of the inner and the outer concrete cages and the second leg is manually flexed backward toward the first plane to engage the one of the inner and the outer concrete cages to engage the pipe with the continuous length of material resting on the pipe to securely combine the spacer to the one of the inner and the outer concrete cages.

9. The spacer of claim 8, wherein the first leg and the second leg are each at an angle α from the first radius of the bend of the continuous length of material.

10. The spacer of claim 9, wherein the angle of α is one degree to forty five degrees or any angle in between.

11. The spacer of claim 8, wherein the third radius is ninety degrees.

12. The spacer of claim 8, wherein the angle β is one degree to twenty degrees or any angle in between.

13. The spacer of claim 8, wherein the third radius is substantially near eighty five degrees.

* * * * *